United States Patent [19]

Dahlén et al.

[11] Patent Number: 4,862,865

[45] Date of Patent: Sep. 5, 1989

[54] INSULATION MATERIAL AND METHOD OF APPLYING THE SAME TO A COMPONENT IN A COMBUSTION ENGINE

[75] Inventors: Lars M. G. Dahlén, Gothenburg; Lars E. Larsson, Ke,uml/o/ ping; Bo L. A. Othzén, Älvängen, all of Sweden

[73] Assignee: AB Volvo, Gothenburg, Sweden

[21] Appl. No.: 161,078

[22] PCT Filed: Jul. 3, 1987

[86] PCT No.: PCT/SE87/00317

§ 371 Date: Feb. 9, 1988

§ 102(e) Date: Feb. 9, 1988

[87] PCT Pub. No.: WO88/00288

PCT Pub. Date: Jan. 14, 1988

[30] Foreign Application Priority Data

Jul. 4, 1986 [SE] Sweden ..... 8602993

[51] Int. Cl.[4] ..... F02B 77/02; F02F 3/12

[52] U.S. Cl. ..... 123/669; 123/188 AA; 123/193 P

[58] Field of Search ..... 123/90.51, 188 AA, 193 R, 123/193 C, 193 CH, 193 CP, 193 H, 193 P, 668, 669; 252/62

[56] References Cited

U.S. PATENT DOCUMENTS

| | | | |
|---|---|---|---|
| 4,254,621 | 3/1981 | Nagumo | 123/669 X |
| 4,334,507 | 6/1982 | Kohnert et al. | 123/193 P |
| 4,485,770 | 12/1984 | Saka et al. | 123/90.51 X |
| 4,524,498 | 6/1985 | Hartsock | 123/669 X |
| 4,646,692 | 3/1987 | Deuber et al. | 123/669 X |
| 4,694,813 | 9/1987 | Mielke | 123/668 |

FOREIGN PATENT DOCUMENTS 2079401 1/1982 United Kingdom .

*Primary Examiner*—Willis R. Wolfe
*Attorney, Agent, or Firm*—Young & Thompson

[57] ABSTRACT

A thermal insulating material for combustion engine components, which are subjected to combustion gases, e.g. pistons. The insulation consists of a metal layer sintered under low pressure so as to have a porosity of about 25–50% and which is bonded to the engine component by casting of the component onto the porous sintered layer. The exposed or wear-receiving surface of the sintered layer is machined, which not only achieves accurate dimensioning but also closes the pores of the surface.

7 Claims, 1 Drawing Sheet

Figure 1:
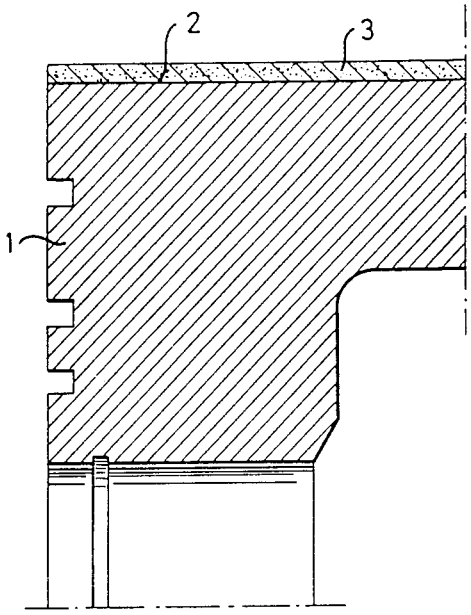

INSULATION MATERIAL AND METHOD OF APPLYING THE SAME TO A COMPONENT IN A COMBUSTION ENGINE

The present invention relates to a insulating material for thermal insulation of components exposed to combustion gases in an internal combustion engine. The invention also relates to a method of thermally insulating a surface of an engine component.

It is a known fact that by thermally insulating components in combustion engines, such as pistons, combustion chamber walls, valves and exhaust ducts with an insulating material with a lower coefficient of thermal conductivity than the metal in the components it is possible to shift the heat from the cooling water to the exhaust gases. The dimensions of the radiator and water pump for example can thus be reduced and a certain increase in engine efficiency can be achieved, especially in combination with a so-called turbo compound, in which case an increase on the order of 5% can be achieved.

Various ceramic materials having a low coefficient of therml conductivity have for example been used as insulating materials in this context. The problem with ceramic material is, however, that they are brittle and break easily during assembly and engine operation. Furthermore, it is difficult to get the ceramic material to bond to the metal substrate due to the relatively large differences in thermal expansion coefficient between the metal and the ceramic.

In order to avoid the problems accompanying the use of ceramic insulating materials in engines, the use of a purely metallic insulating layer has been suggested, consisting of metal nets sintered together to form a porous layer. A thin metal platee of stainless steel is sintered or soldered to the net layer consisting of nets to form a tight corrosion resistant, heat resistant surface layer. The insulating layer as a whole can be soldered to the engine component or placed in its mold and bonded to the component as the component is cast.

The use of such an insulating layer has its limitations, however, in that it cannot be machined. In certain locations in an engine, the tolerances between the various components, e.g. between the top of the piston and the cylinder head in a diesel engine, are narrower than the castoing tolerances. The former can be fractions of a millimeter while casting tolerances of less than ca 1.5 mm are difficult to achieve in practice.

The purpose of the present invention is to achieve a metallic insulating material which does not have the above-mentioned practical limitations.

This is achieved according to the invention in that the material comprises an insulating layer of porous sintered metallic powder.

In normal production of sintered components, the pressure used before sintering is so high that the porosity does not amount to more than a few percent of the volume. As a rule, one tries to achieve a porosity which is as low as possible and residual porosity after sintering is then not something which is desirable. When producing the insulating layer according to the invention, however, a lower compression pressure is used which results in a porosity of up to about 50%. This gives a coefficient of thermal conductivity which approaches the coefficient of the ceramic materials which have been used for the same purpose.

The sintered insulating layer can be machined in the same steps as the engine component which is the substrate. Not only does this provide the component with the desired shape and dimensions, but the surface pores of the sintered layer are to a great extent sealed.

Figure 2:
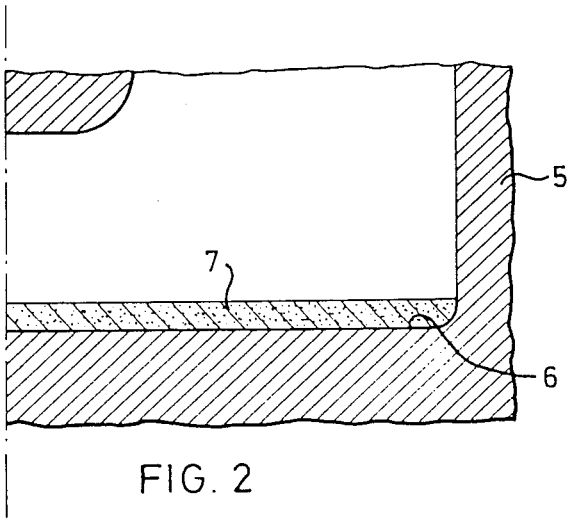

The invention will be described in more detail with reference to an example shown in the accompanying drawing, in which FIG. 1 shows a section through a portion of a piston and FIG. 2 is a section through a portion of a mold for casting the piston in FIG. 1.

The piston shown in FIG. 1 has a cast metal body 1. The upper surface 2 of the metal body is in the embodiment shown completely flat, as is common practice in petrol or gasoline engines, but it could just as easily have been made with the depression in the upper surface of the piston which is characteristic for direct injection diesel engines.

The entire upper surface 2 of the piston body 1 is covered by a sintered porous metal layer 3 approximately 5 mm thick, which in a preferred embodiment has been produced under low compression, which after sintering results in a porosity of ca 25%, and a coefficient of thermal conductivity of 3–3.5 W/m.K, which is comparable to coefficients of thermal conductivity of 2–3 W/m.K for ceramic materials for the same purpose. Tests have shown that the porosity in the sintered material should be at least 15% to be able to achieve the desired insulation properties.

The upper limit for the porosity is determined by the strength requirements of the component in question. For components with the lowest strength requirements, e.g. exhaust ducts, the upper limit is about 50%.

Between the surface layer 2 of the aluminum body 1 and the insulating layer 3, there is a purely metallic bond. The two pacts are bonded together during casting.

FIG. 2 shows a casting mold 5 on the bottom 6 of which a sintered plate 7 is placed which fill form the insulating layer 3. The plate 7 is made with a somewhat greater thickness than the finished insulating layer, e.g. ca 7 mm for an insulating layer of about 5 mm. After placing the disc 7 in the mold 5, the aluminum melt is poured into the mold and when it has hardened it will form a piston blank metallically bonded to the disc. The piston blank is machined in the same manner as a blank entirely produced in cast metal. The machining of the insulating layer on the piston end surface results in a sealing of the surface layer.

The insulating material according to the invention has been described above with reference to its use for a piston with a flat end surface, but it can of course also be applied to insulating other pistons, e.g. those with a depression in the piston end surface, and for valves, combustion chamber walls, cylinder liners and exhaust ducts, in other words for all engine components which are subjected to combustion gases, and not only to those surfaces directly subjected to combustion gases but also those other surfaces, e.g. the outside of an intake valve.

We claim:

1. A combustion engine component having a surface exposed to combustion gases, said surface being coated with a thermally insulating material, characterized in that the insulating material consists entirely of a porous insulating layer of sintered metal powder compressed under low pressure prior to sintering.

2. A combustion engine component according to claim 1, characterized in that the porosity of the insulating layer (3) is at least 15%.

3. A combustion engine component according to claim 1, characterized in that the porosity of the insulating layer (3) is about 25–50%.

4. A combustion engine component according to claim 1 characterized in that the sintered layer (3) has a machined surface whose pores are closed.

5. Method of insulating a surface on a combustion engine component, characterized in that an insulating layer (7) with a shape adapted to the surface to be insulated is produced by sintering a metal powder compressed under low pressure, producing a porous layer, whereafter the insulating layer is placed in the mold (5) for the component (1) before the mold is filled with molten metal, the layer with cast metal thereon, when removed from the mold, having an exposed surface consisting entirely of sintered porous metal.

6. Method according to claim 5, characterized in that the thickness of the insulating layer (7) is overdimensioned and that the layer is machined to specific dimensions after being bonded through casting, thereby also closing the pores of said surface.

7. Method according to claim 5, characterized in that the compression and sintering are carried out under a pressure and with a powder material which produces a porosity of about 25%–50%.

* * * * *